US010581188B2

(12) United States Patent
Gu et al.

(10) Patent No.: US 10,581,188 B2
(45) Date of Patent: Mar. 3, 2020

(54) POWER INTERFACE, MOBILE TERMINAL, AND POWER ADAPTER

(71) Applicant: GUANGDONG OPPO MOBILE TELECOMMUNICATIONS CORP., LTD., Dongguan, Guangdong (CN)

(72) Inventors: Guodong Gu, Guangdong (CN); Feifei Li, Guangdong (CN)

(73) Assignee: GUANGDONG OPPO MOBILE TELECOMMUNICATIONS CORP., LTD., Dongguan, Guangdong (CN)

( * ) Notice: Subject to any disclaimer, the term of this patent is extended or adjusted under 35 U.S.C. 154(b) by 0 days.

(21) Appl. No.: 16/202,415

(22) Filed: Nov. 28, 2018

(65) Prior Publication Data

US 2019/0097338 A1 Mar. 28, 2019

Related U.S. Application Data

(63) Continuation of application No. PCT/CN2017/081157, filed on Apr. 19, 2017.

(30) Foreign Application Priority Data

Jul. 27, 2016 (CN) ..... 2016 2 0806867 U

(51) Int. Cl.

| | |
|---|---|
| ***H01R 12/00*** | (2006.01) |
| ***H01R 12/72*** | (2011.01) |
| ***H01R 12/70*** | (2011.01) |
| ***H01R 13/22*** | (2006.01) |
| ***H01R 13/405*** | (2006.01) |

(52) U.S. Cl.

CPC ..... *H01R 12/727* (2013.01); *H01R 12/7088* (2013.01); *H01R 12/725* (2013.01); *H01R 13/22* (2013.01); *H01R 13/405* (2013.01)

(58) Field of Classification Search

CPC ..... H01R 12/727; H01R 12/7088; H01R 12/725; H01R 13/22; H01R 13/405

USPC ..... 439/78, 79, 660

See application file for complete search history.

(56) References Cited

U.S. PATENT DOCUMENTS

| | | | | |
|---|---|---|---|---|
| 5,148,354 A | 9/1992 | Roth | | |
| 5,785,557 A * | 7/1998 | Davis | H01R 13/26 | 439/108 |
| 7,670,199 B2 * | 3/2010 | Nagata | H01R 13/6474 | 439/101 |

(Continued)

FOREIGN PATENT DOCUMENTS

| | | |
|---|---|---|
| CN | 203166148 U | 8/2013 |
| CN | 203553401 U | 4/2014 |
| CN | 205282692 U | 6/2016 |

(Continued)

*Primary Examiner* — Khiem M Nguyen

(74) *Attorney, Agent, or Firm* — Ladas & Parry, LLP

(57) ABSTRACT

A power interface, a mobile terminal, and a power adapter are disclosed. The power interface may include a main body, a plurality of spaced data pins, and a plurality of spaced power pins. The main body is configured to be connected to a circuit board. The data pins and power pins are connected to the main body and spaced from each other. Each of the power pins includes a conductive portion and an insulating portion connected with the conductive portion, and the conductive portion and the insulating portion are arranged along a width direction of each of the power pins.

7 Claims, 5 Drawing Sheets

(56) References Cited

U.S. PATENT DOCUMENTS

| | | | | |
|---|---|---|---|---|
| 10,211,580 | B2 * | 2/2019 | Zhao | H01R 13/04 |
| 2015/0244110 | A1 * | 8/2015 | Ju | H01R 13/6585<br>439/607.01 |

FOREIGN PATENT DOCUMENTS

| | | | |
|---|---|---|---|
| CN | 106025616 | A | 10/2016 |
| CN | 205863454 | U | 1/2017 |
| CN | 205882209 | U | 1/2017 |
| CN | 205882228 | U | 1/2017 |
| CN | 205960264 | U | 2/2017 |

* cited by examiner

POWER INTERFACE, MOBILE TERMINAL, AND POWER ADAPTER

CROSS REFERENCE TO RELATED APPLICATIONS

The present application is a continuation-application of International (PCT) Patent Application No. PCT/CN2017/081157 filed Apr. 19, 2017, which claims foreign priority of Chinese Patent Application No. 201620806867.0, filed on Jul. 27, 2016, the entire contents of which are hereby incorporated by reference in their entireties.

TECHNICAL FIELD

The described embodiments relate to communication technology, and in particular to a power interface, a mobile terminal, and a power adapter.

BACKGROUND

With the advancement of times, Internet and mobile communication networks provide a huge number of functional applications. Users can use mobile terminals not only for traditional applications, for example, using smart phones to answer or make calls, but also for browsing web, transferring picture, playing games, and the like at the same time.

While using a mobile terminal to handle things, due to the increase in frequencies of using the mobile terminals, it will consume a large amount of powers of batteries in the mobile terminals, such that the batteries need to be charged frequently. Furthermore, due to the acceleration of the pace of life, especially the increasing of sudden and urgencies, the users hope that the batteries of the mobile terminals are charged with a large current.

BRIEF DESCRIPTION OF THE DRAWINGS

In order to make the technical solution described in the embodiments of the present disclosure more clear, the drawings used for the description of the embodiments will be briefly described. Apparently, the drawings described below are only for illustration but not for limitation. It should be understood that, one skilled in the art may acquire other drawings based on these drawings, without making any inventive work.

DETAILED DESCRIPTION

Embodiments of the present disclosure will be described in detail below, and examples of the embodiments will be illustrated in the accompanying drawings. The embodiments described below with reference to the drawings are illustrative and are intended to explain the present disclosure, and cannot be construed as a limitation to the present disclosure.

In the description of the present disclosure, it is to be understood that terms such as "length", "width", "thickness", "upper", "lower", "front", "rear", "left", "right", "bottom", "inner", "outer", "circumference", and the like, refer to the orientations and locational relations illustrated in the accompanying drawings. Thus, these terms used here are only for describing the present disclosure and for describing in a simple manner, and are not intended to indicate or imply that the device or the elements are disposed to locate at the specific directions or are structured and performed in the specific directions, which could not to be understood as limiting the present disclosure.

In addition, terms such as "first", "second", and the like are used herein for purposes of description, and are not intended to indicate or imply relative importance or significance or to imply the number of indicated technical features. Thus, the feature defined with "first", "second", and the like may include one or more of such a feature. In the description of the present disclosure, "a plurality of" means two or more, such as two, three, and the like, unless specified otherwise.

In the present disclosure, unless specified or limited, otherwise, terms "mounted", "connected", "coupled", "fixed", and the like are used in a broad sense, and may include, for example, fixed connections, detachable connections, or integral connections; may also be mechanical or electrical connections; may also be direct connections or indirect connections via intervening structures; may also be inner communications of two elements, as can be understood by one skilled in the art depending on specific contexts.

In the following, a power interface 100 may be will be described in embodiments of the present disclosure with reference to FIGS. 1-9. It should be understood that, the power interface 100 may include an interface configured for charging or data transmission, and may be disposed in a mobile terminal such as a mobile phone, a tablet computer, a laptop, an in-vehicle device, or any other suitable mobile terminal having a rechargeable function. The power interface 100 may be electrically connected to a corresponding power adapter to achieve a communication of electrical signals and data signals.

Referring to FIGS. 1-9, the power interface 100 according to an embodiment of the present disclosure may include a main body 110, a plurality of data pins 120, and a plurality of power pins 130.

Figure 9:
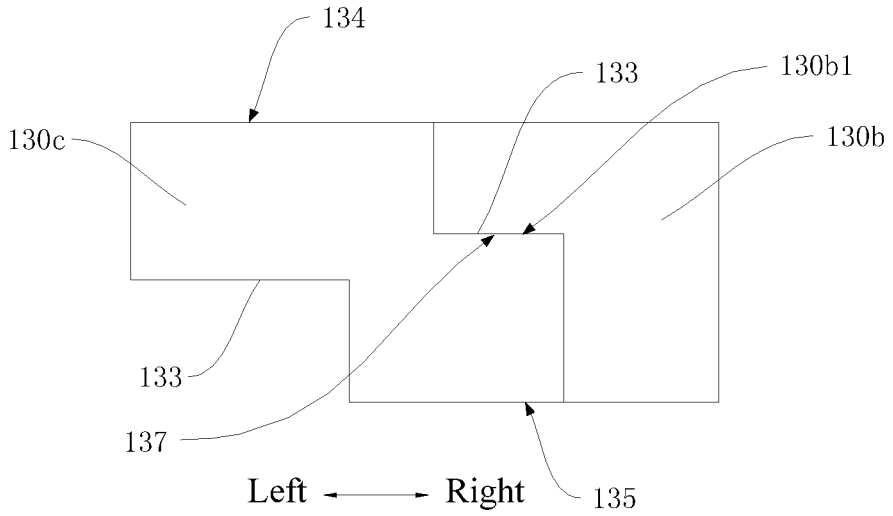
FIG. 9 is a structural schematic view of a power pin according to an embodiment of the present disclosure.

Specifically, the main body 110 is adapted to be connected to a circuit board, and the data pins 120 may be spaced apart from each other and connected to the main body 110. The power pins 130 may be spaced apart and connected to the main body 110. The power pins 130 and the data pins 120 are spaced apart. The power pin 130 includes a conductive portion 130*a* and an insulating portion 130*b* connected to the conductive portion 130*a*. The conductive portion 130*a* and the insulating portion 130*b* are arranged in a width direction of the power pin 130 (i.e., left-right direction as shown in FIG. 9).

It should be noted that, the power interface 100 may be disposed on a mobile terminal, and a battery can be disposed inside the mobile terminal (e.g., a mobile phone, a tablet computer, a notebook computer, etc.). The battery may be charged by an external power source via the power interface 100. The power interface 100 can be used for a power adapter with a fast charging function and a normal power adapter. The fast charging herein may refer to a charging state in which a charging current is greater than 2.5 A, or a charging state in which a rated output power is not less than 15 W. The normal charging herein may refer to a charging state in which the charging current is less than or equal to 2.5 A, or a charging state in which the rated output power is less than 15 W. That is, when the power interface 100 is charged by the power adapter with the fast charging function, the charging current is greater than or equal to 2.5 A, or the rated output power is not less than 15 W. When the power interface 100 is charged by the normal power adapter, the charging current is less than 2.5 A, or the rated output power is less than 15 W.

Figure 1:
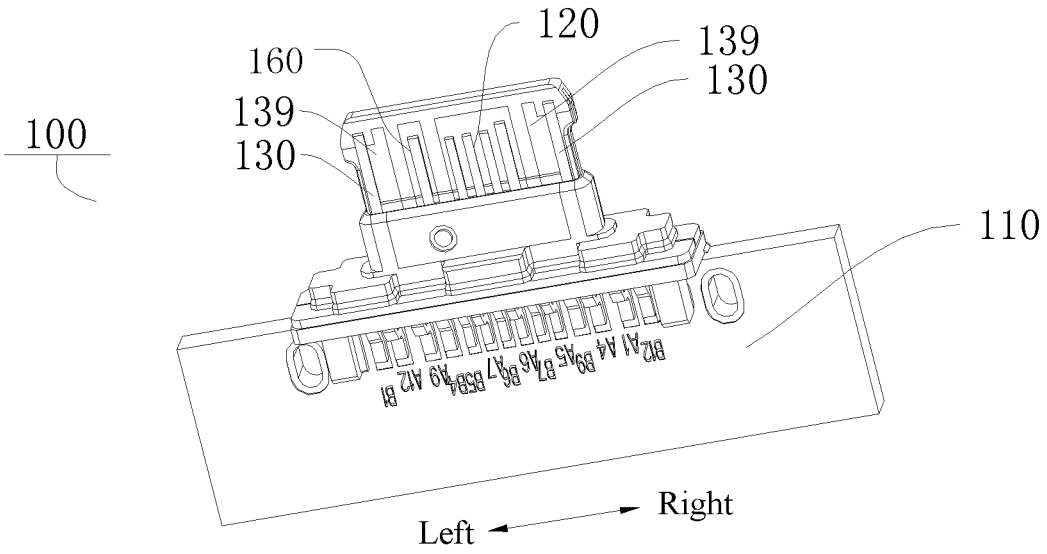
FIG. 1 is a partially structural schematic view of a power interface according to an embodiment of the present disclosure.

In order to standardize the power interface 100 and a power adapter that is compatible with the power interface 100, a size of the power interface 100 may need to meet design requirements of a standard interface. For example, for the power interface 100 with 24 pins, the design requirements are that, its width (i.e. the width in the left-right direction of the power interface 100, and the left-right direction is shown in FIG. 1) is a. In order to make the power interface 100 in this embodiment meet design standard, and the width of the power interface 100 in this embodiment (i.e. the width in the left-right direction of the power interface 100, and the left-right direction is shown in FIG. 1) may also be a. In order to enable the power pins 130 to carry a large charging current in a limited space, some of the 24 pins may be omitted, and the insulating portion 130*b* is filled at the position of the omitted pins.

In the power interface 100 according to an embodiment of the present disclosure, a structure of the power pins 130 is designed as a structure of the conductive portion 130*a* and the insulating portion 130*b*, and then the power interface 100 can be applied to different power adapters, thereby expanding an application range of the power interface 100 and improving a performance of the power interface 100.

Figure 2:
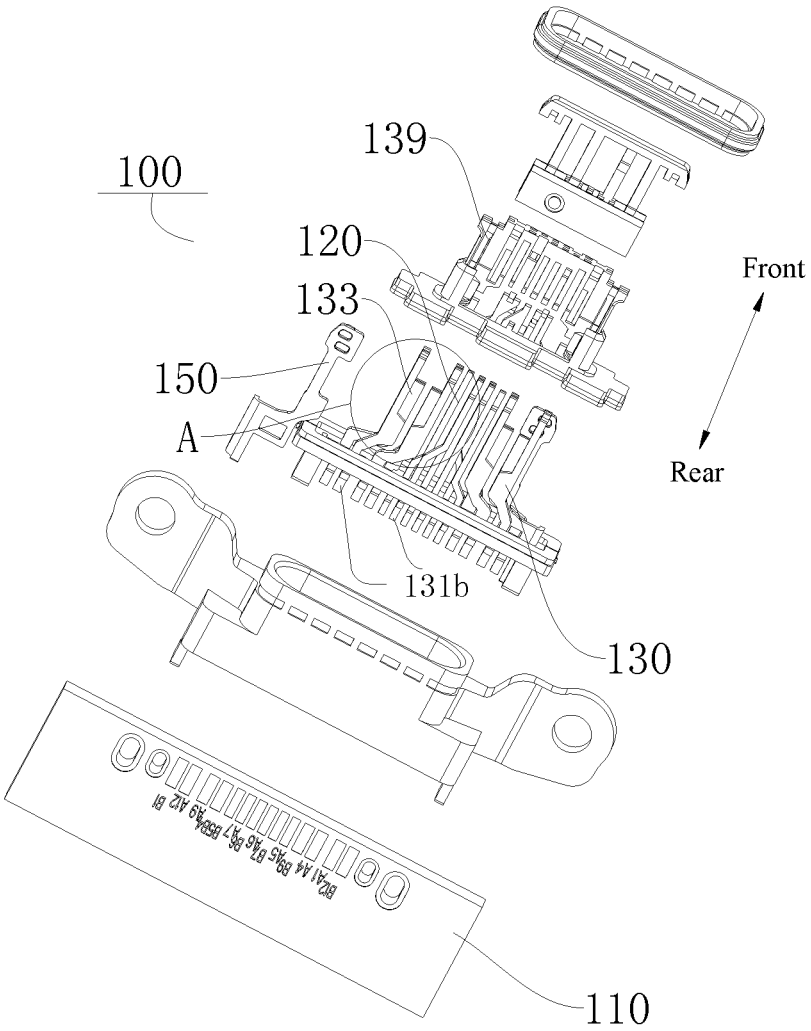
FIG. 2 is an explored view of a power interface according to an embodiment of the present disclosure.

According to an embodiment of the present disclosure, at least one of the power pins 130 may include an expanded portion 132. The insulating portion 130*b* and a part of the conductive portion 130*a* of the at least one of the power pins 130 are located on the expanded portion 132. A cross-sectional area of the conductive portion 130*a* is larger than that of the data pin 120, such that the current load amount of the power pins 130 is to be increased. Therefore, with the expanded section 132 provided on the power pins 130, the current load amount of the power pins 130 may be increased, so that the current transmission speed may be increased, and the power interface 100 can have the fast charging function, which improves charging efficiency for a battery. In order to further improve the ability of the power pins 130 to carry current, according to an embodiment of the present disclosure, the conductive portion 130*a* may have a length (the length herein refers to the length in a front-rear direction as shown in FIG. 2), which is greater than that of the insulating portion 130*b* (the length herein refers to the length in the front-rear direction as shown in FIG. 2).

According to an embodiment of the disclosure, the cross-sectional area of the conductive portion 130*a* on the expanded portion 132 may be defined as S, and $S \geq 0.09805$ $mm^2$. It has been experimentally verified that when $S \geq 0.09805$ $mm^2$, the current load amount of the power pins 130 may be at least 10 A. Therefore, the charging efficiency can be improved by increasing the current load amount of the power pins 130. After further tests, when $S=0.13125$ $mm^2$, the current load amount of the power pins 130 may be 12 A or more, which can improve charging efficiency.

According to an embodiment of the disclosure, the power pin 130 have a thickness D, which meets $0.1\ mm \leq D \leq 0.3$ mm. It has been experimentally verified that when $0.1\ mm \leq D \leq 0.3$ mm, the current load amount of the power pins 130 is at least 10 A, which can improve the charging efficiency by increasing the current load of the power pins 130. After further tests, when D=0.25 mm, the current load amount of the power pins 130 may be greatly increased, and the current load amount of the power pins 130 is 12 A or more, which can improve the charging efficiency.

Figure 6:
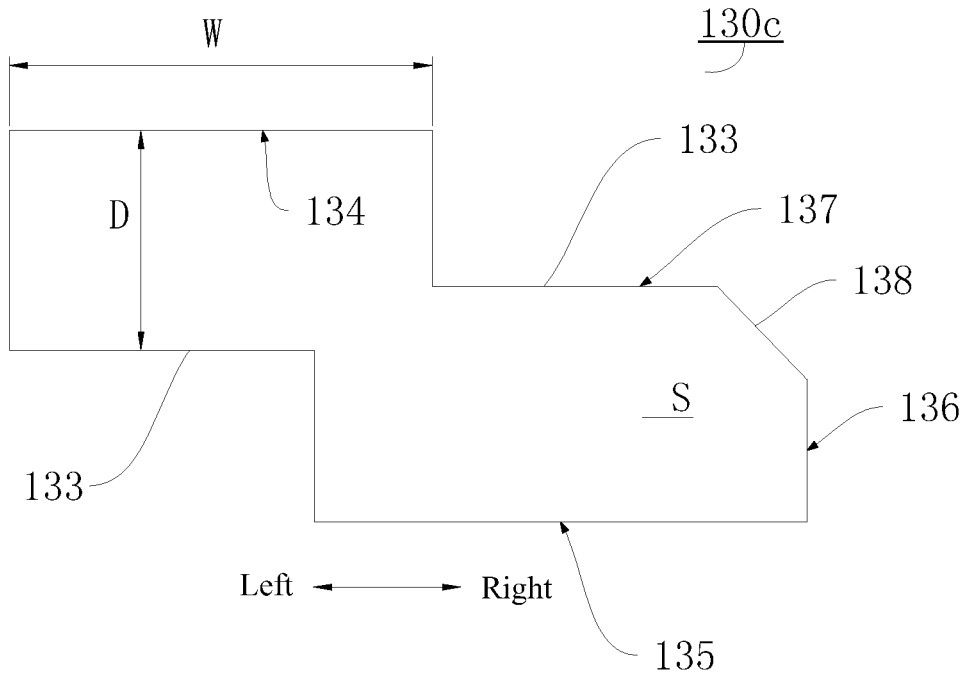
FIG. 6 is a structural schematic view of a power pin according to an embodiment of the present disclosure.
Figure 10:
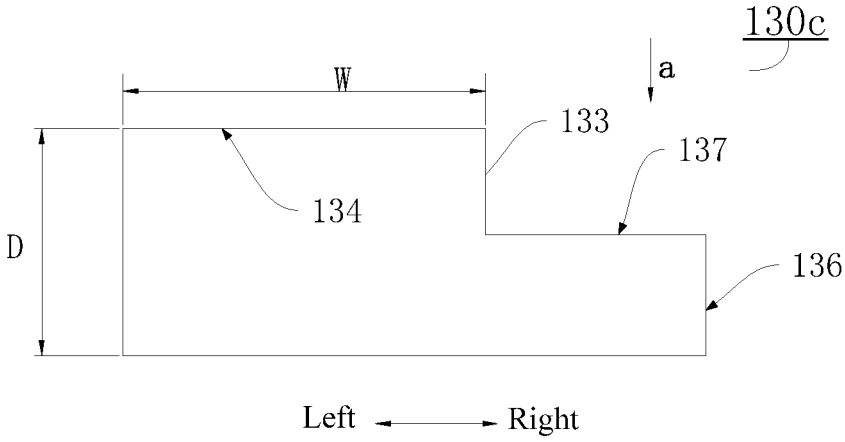
FIG. 10 is a structural schematic view of a power pin according to an embodiment of the present disclosure.

Referring to FIGS. 6 and 10, according to an embodiment of the present disclosure, in the width direction of the power pin 130 (i.e. the left-right direction shown in FIGS. 6 and 10), a width of a contact surface is defined as W, which meets $0.24\ mm \leq W \leq 0.32$ mm. It has been experimentally verified that when 0.24 mm $W \leq 0.32$ mm, the current load amount of the power pin 130 is at least 10 A, which may improve the charging efficiency by increasing the current load amount of the power pins 130. After further tests, when W=0.25 mm, the current load amount of the power pin 130 can be greatly increased. The current load of the power pins 130 is 12 A or more, which improves the charging efficiency.

Referring to FIG. 2, according to an embodiment of the present disclosure, the expanded portion 132 can be located at the middle of the power pin 130. Therefore, the layout of the power pins 130 and the data pins 120 can be optimized, and the space which the power interface 100 occupies can be fully utilized. The structure and the rationality of the power interface 100 can be improved.

According to an embodiment of the present disclosure, the conductive portion 132*a* where is located on the expanded portion 132 defines a recess 133. It should be noted that, when the power interface 100 performs the fast charging function, the power pins 130 with the expanded portion 132 may be used to carry a large charging current. When the power interface 100 performs the normal charging function, the recess 133 on the expanded portion 132 may make the power pins 130 prevented from being contacted with corresponding pins of a power adapter. Therefore, the power interface 100 in this embodiment can be applied to different power adapters. For example, when the power interface 100 performs the fast charging function, the power interface 100 can be electrically connected to a corresponding power adapter with the fast charging function. When the power interface 100 performs the normal charging function, the power interface 100 can be electrically connected to a corresponding normal power adapter. It should be noted that, the fast charging function herein may refer to a charging state in which the charging current is greater than or equal to 2.5 A, and the normal charging may refer to a charging state in which the charging current is less than 2.5 A.

Further, in order to improve the use stability of the power interface 100, a part of the insulating portion 130*b* may be filled in the recess 133. Therefore, when the power interface 100 performs the normal charging, the insulating portion 130*b* can effectively separate the power pins 130 from the corresponding pins of the power adapter, which prevents the expanded portion 132 from generating charging interference on the corresponding pins of the power adapter. Thus, the power interface 100 may be adapted to power adapters with the normal charging, and the stability for the power interface 100 under normal charging conditions may be improved.

Referring to FIG. 10, according to some embodiments of the present disclosure, there may be one recess 133. The recess 133 is located on the first sidewall 134 of the expanded portion 132. The first sidewall 134 is adapted to be electrically connected to an electronic element. It should be noted that, when the power interface 100 is electrically connected to the power adapter, the corresponding pins of the power adapter, which is used as the electronic element, are electrically connected to the first sidewall 134 of the power pin 130. It can be understood that, when the power interface 100 is electrically connected to the power adapter, the corresponding pins of the power adapter is closely attached to the first sidewall 134 of the power pins 130, so that a stable electrical connection between the power interface 100 and the power adapter may be realized.

According to further embodiments of the present disclosure, there may be two recesses 133. The two recesses 133 are located on the first sidewall 134 and the second sidewall 135 of the expanded portion 132, respectively. The first sidewall 134 is adapted to be electrically connected to an electronic element. The second sidewall 135 is opposite to the first sidewall 134. The two recesses 133 are spaced apart in the width direction of the expanded portion 132. For example, as shown in FIGS. 4-8, the width direction of the expanded portion 132 may be the left-right direction shown in FIGS. 4-8. The first sidewall 134 faces the outer side of the power interface 100 (i.e., the outer side shown in FIG. 5). The second sidewall 135 faces the inner side of the power interface 100 (i.e., the inner side shown in FIG. 5). The two recesses 133 are spaced apart in the left-right direction, one of which is located on the first sidewall 134 and the other is located on the second sidewall 135.

Figure 7:
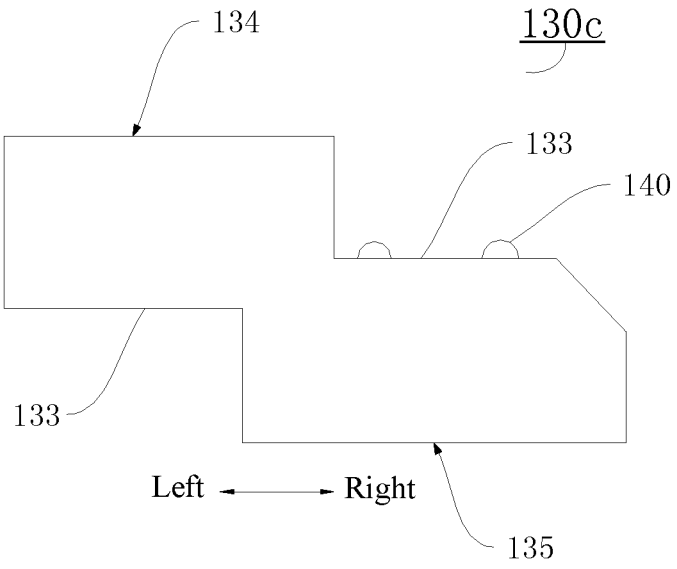
FIG. 7 is a structural schematic view of a power pin according to an embodiment of the present disclosure.
Figure 8:
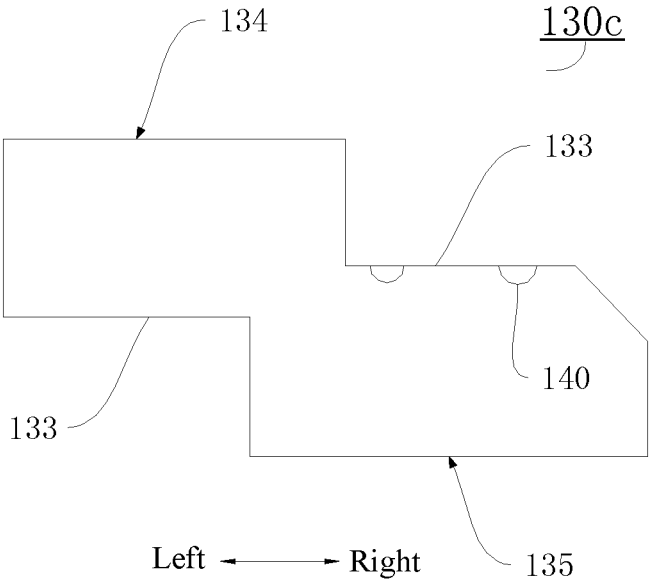
FIG. 8 is a structural schematic view of a power pin according to an embodiment of the present disclosure.

Referring to FIGS. 7 and 8, according to an embodiment of the present disclosure, a wall surface of the conductive portion 130*a* where the conductive portion 130*a* is connected to the insulating portion 130*b* is defined as a first wall surface 137. A wall surface of the insulating portion 130*b* where the insulating portion 130*b* is connected to the conductive portion 130*a* is defined as a second wall surface 130*b*1. At least one of the first wall surface 137 and the second wall surface 130*b*1 is provided with a rough portion 140. Therefore, a contact area between the conductive portion 130*a* and the insulating portion 130*b* may be increased, so that the connection fastness between the conductive portion 130*a* and the insulating portion 130*b* may be enhanced. Referring to FIG. 7, in some examples of the present disclosure, the rough portion 140 may include protrusions. Referring to FIG. 8, in other embodiments of the present disclosure, the rough portion 140 may include a plurality of recesses. In some embodiments of the present disclosure, the rough portion 140 may also be formed as a rough surface.

According to some embodiments of the present disclosure, a wall surface of the conductive portion 130*a*, which is adjacent to the first wall surface 137, is defined as a third wall surface 136. An angle 138 of chamfer is defined between the third wall surface and first wall surface. It should be noted that the angle of chamfer may increase the contact area between the conductive portion 130*a* and the insulating portion 130*b*, which improves the connection strength and connection reliability between the conductive portion 130*a* and the insulating portion 130*b*, and may also make the external surfaces of the power pins 130 smooth and transitional. In addition, when the power pin 130 needs to be processed by a stamping process, the angle of chamfer may also be used to accommodate residual material generated during the stamping process, which improves the smoothness of an external surface of the power pins 130.

Referring to FIGS. 1-10, the power interface 100 according to embodiments of the present disclosure is described in detail. It is noted that, the following description only is exemplary, and is not limitation to the present disclosure.

For convenience to describe, an example where the power interface 100 is implemented as a Type-C interface is described. The Type-C interface may also be called an USB Type-C interface. The Type-C interface belongs to a type of an interface, and is a new data, video, audio and power transmission interface specification developed and customized by the USB standardization organization to solve the drawbacks present for a long time that the physical interface specifications of the USB interface are uniform, and that the power can only be transmitted in one direction.

The Type-C interface may have the following features: a standard device may declare its willing to occupy a VBUS (that is, a positive connection wire of a traditional USB) to another device through a CC (Configuration Channel) pin in the interface specification. The device having a stronger willing may eventually output voltages and currents to the VBUS, while the another device may accept the power supplied from the VBUS bus, or the another device may still refuse to accept the power; however, it does not affect the transmission function. In order to use the definition of the bus more conveniently, a Type-C interface chip (such as LDR6013) may generally classify devices into four types: DFP (Downstream-facing Port), Strong DRP (Dual Role Power), DRP, and UFP (Upstream-facing Port). The willingness of these four types to occupy the VBUS bus may gradually decrease.

The DFP may correspond to an adapter, and may continuously output voltages to the VBUS. The Strong DRP may correspond to a mobile power, and may give up outputting voltages to the VBUS only when the strong DRP encounters the adapter. The DRP may correspond to a mobile phone. Normally, the DRP may expect other devices to supply power to itself. However, when encountering a device that has a weaker willingness, the DRP may also output the voltages and currents to the device. The UFP will not output electrical power externally. Generally, the UFP is a weak battery device, or a device without any batteries, such as a Bluetooth headset. The USB Type-C interface may support the insertions both from a positive side and a negative side. Since there are four groups of power sources and grounds on both sides (the positive side and the negative side), the power supported by USB Type-C interface may be greatly improved.

The power interface 100 in this embodiment may be a USB Type-C interface, which may be applied to a power adapter with the fast charging function, or a normal power adapter. The fast charging herein may refer to a charging state in which a charging current is greater than 2.5 A. The normal charging herein may refer to a charging state in which the charging current is less than or equal to 2.5 A. That is, when the power interface 100 is charged by the power adapter with the fast charging function, the charging current is greater than or equal to 2.5 A. When the power interface 100 is charged by the normal power adapter, the charging current is less than 2.5 A.

In order to standardize the power interface 100 and a power adapter that is compatible with the power interface 100, a size of the power interface 100 may need to meet design requirements of a standard interface. For example, for the power interface 100 with 24 pins, the design requirements are that, its width (i.e. the width in the left-right direction of the power interface 100, and the left-right direction is shown in FIG. 1) is a. In order to make the power interface 100 in this embodiment meet the design standard, and the width of the power interface 100 in this embodiment (i.e. the width in the left-right direction of the power interface 100, and the left-right direction is shown in FIG. 1)

may also be a. In order to enable the power pins 130 to carry a large charging current in a limited space, some of the 24 pins may be omitted, and the cross-sectional area of the power pin 130 may be expanded, which is used to carry a large load. The expanded part of the power pins 130 can be arranged at the position of the omitted pins. On the one hand, the layout of the power interface 100 is optimized, and on the other hand, the ability of power pins 130 to carry current can be increased.

Figure 3:
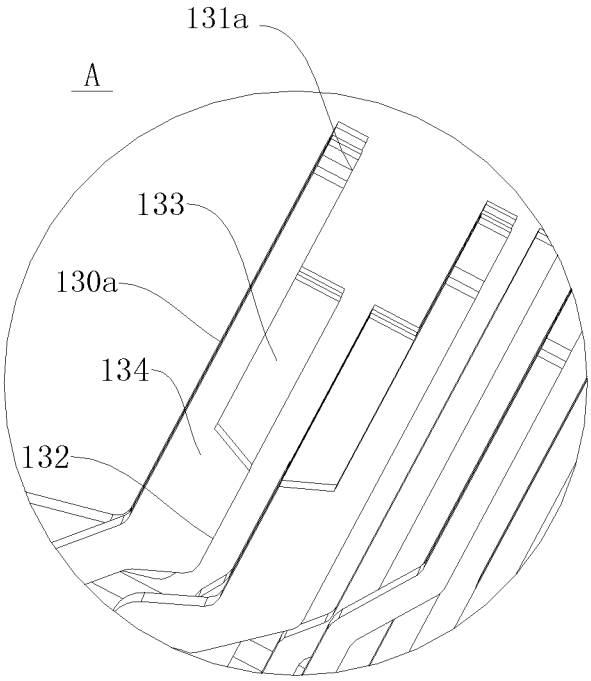
FIG. 3 is a partially enlarged view of portion A of FIG. 2.

Specifically, referring to FIGS. 1-3, the power interface 100 may include a main body 110, six data pins 120, and eight power pins 130. The six data pins 120 are marked as A5, A6, A7, B5, B6, B7, respectively. The eight power pins 130 are marked as A1, A4, A9, A12, B1, B4, B9, B12, respectively. There are four VBUSs and four GNDs among the eight power pins 130. The intermediate patch 150 is interposed between every two GNDs. It should be noted that, the power interface 100 may be disposed on a mobile terminal, and a battery can be disposed inside the mobile terminal (e.g., a mobile phone, a tablet computer, a notebook computer, etc.). The battery may be charged by an external power source via the power interface 100.

The main body 110 is adapted to be connected to a circuit board, and the data pins 120 may be spaced apart from each other and connected to the main body 110. The power pins 130 may be spaced apart and connected to the main body 110. The power pins 130 and the data pins 120 are spaced apart. At least one of the power pins 130 may include an expanded portion 132. The expanded portion 132 may be located at middle of the power pin 130. The expanded portion 132 may include a conductive portion 130*a* and an insulating portion 130*b* arranged in the left-right direction. The conductive portion 130*a* is connected to the insulating portion 130*b*, and a stepped surface is provided at an end face where the conductive portion 130*a* and the insulating portion 130*b* are connected. A rough portion 140 is formed on the stepped surface. The cross-sectional area of the conductive portion 130*a* is larger than that of the data pin 120, which increases the current load amount of the power pins 130. The expanded portion 132 can occupy the position of the omitted pins. On the one hand, the charging current that the power pin 130 may carry can be increased, and on the other hand, the space utilization rate of the power interface 100 can be improved.

Referring to FIGS. 6 and 10, the thickness of the power pin 130 is defined as D, and the cross-sectional area of the expanded portion 132 is defined as S. It is experimentally verified that, when D=0.25 mm and S=0.13125 $mm^2$, the current load amount of the power pin 130 is at least 12 A, which can improve the charging efficiency. Referring to FIGS. 6 and 10, the power pin 13 has a contact surface configured to be electrically connected to a power adapter, and in the width direction of the power pin 130 (i.e., the left-right direction as shown in FIGS. 6 and 10), a width of the contact surface is defined as W. It is experimentally verified that, when W=0.25 mm, the current load amount of the power pin 130 can be greatly increased. The current load amount of the power pins 130 may be 10 A, 12 A, 14 A or above, which can improve the charging efficiency.

Referring to FIGS. 4-8, a part of the external surface of the power pin 130 and the external surface of the data pins 120 are covered by an encapsulation portion 139. The encapsulation portion 139 may be made of an insulating heat conductive material.

Figure 4:
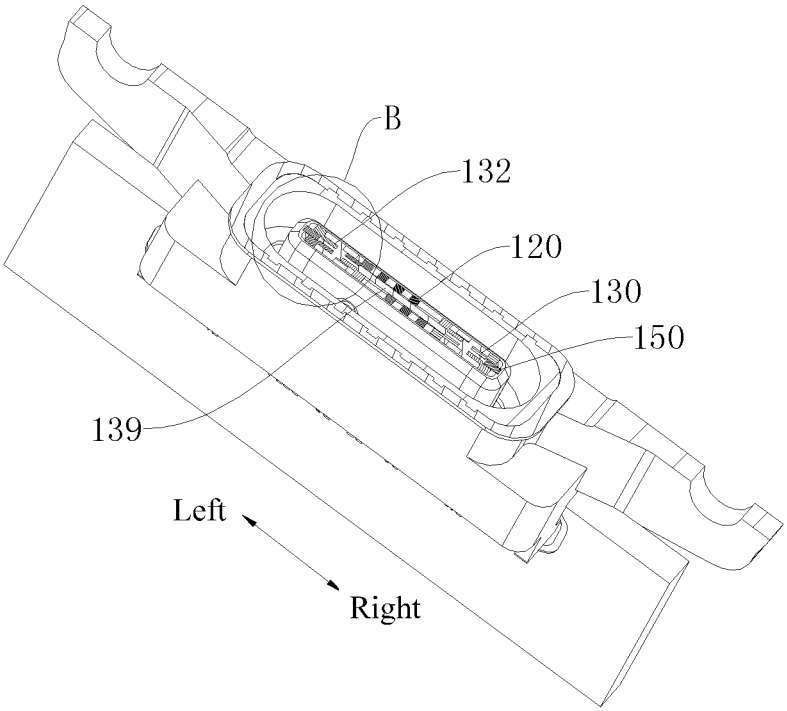
FIG. 4 is a cutaway view of a power interface according to an embodiment of the present disclosure.
Figure 5:
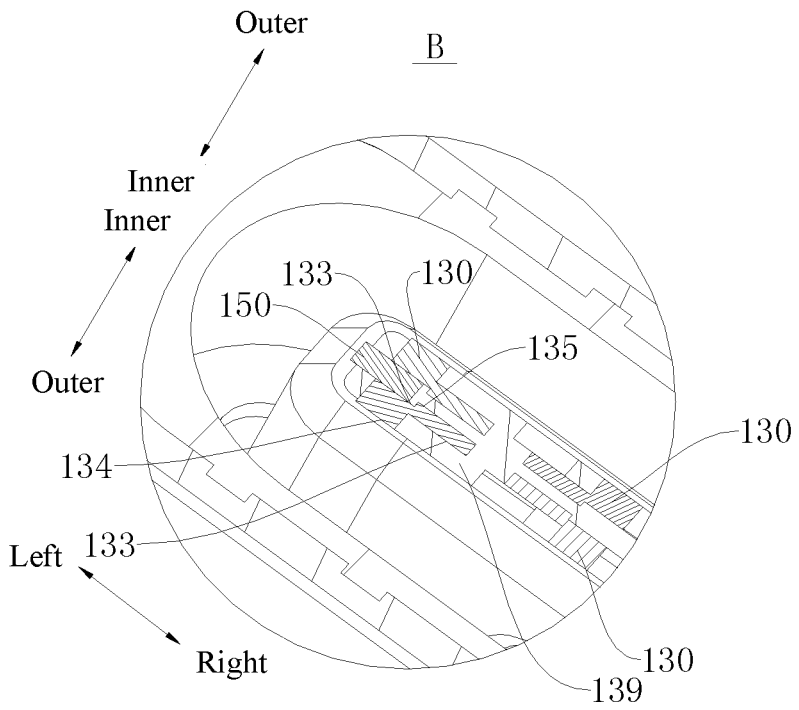
FIG. 5 is a partially enlarged view of portion B of FIG. 4.

Referring to FIG. 6, there may be two recess 133, and the two recess 133 are spaced apart in the left-right direction (i.e., the left-right direction as shown in FIGS. 4-8). Referring to FIGS. 4 and 5, the second sidewall 135 is opposite to the first sidewall 134. The first sidewall 134 is adapted to be electrically connected to an electronic element and faces the outer side of the power interface 100 (i.e., the outer side shown in FIG. 5). The second sidewall 135 is opposite to the first sidewall 134 and faces the inner side of the power interface 100 (i.e., the inner side shown in FIG. 5). One of the two recess 133 is located on the first sidewall 134 and the other is located on the second sidewall 135.

A wall surface of the conductive portion 130*a*, which is adjacent to the first wall surface 137, is defined as a third wall surface 136. An angle 138 of chamfer is defined between the third wall surface 136 and first wall surface 137. It should be noted that, the angle 138 of chamfer may increase the contact area between the conductive portion 130*a* and the insulating portion 130*b*, which improves the connection strength and connection reliability between the conductive portion 130*a* and the insulating portion 130*b*, and may also make the external surfaces of the power pins 130 smooth and transitional. In addition, when the power pins 130 needs to be processed by a stamping process, the angle 138 of chamfer may also be used to accommodate residual material generated during the stamping process, which improves the smoothness of the external surface of the power pins 130.

Therefore, with the expanded section 132 provided on the power pins 130, the current load amount of the power pins 130 may be increased, so that the current transmission speed may be increased, and then the power interface 100 can have a fast charging function, which improves charging efficiency for a battery.

A mobile terminal according to an embodiment of the present disclosure may include the power interface 100 as described above. The mobile terminal can realize the transmission of electrical signals and data signals through the power interface 100. For example, the mobile terminal can be electrically connected to a power adapter through the power interface 100 to implement a charging or data transmission function.

In the mobile terminal according to embodiments of the present disclosure, the current load amount of the power pins 130 can be increased through the expanded portion 132 provided on the power pin 130. Therefore, the current transmission speed may be improved, so that the power interface 100 has a fast charging function, which can improve the charging efficiency of the battery.

A power adapter according to an embodiment of the present disclosure may include the power interface 100 as described above. The mobile terminal can realize the transmission of electrical signals and data signals through the power interface 100.

In the power adapter according to embodiments of the present disclosure, the current load amount of the power pins 130 can be increased through the expanded portion 132 provided on the power pin 130. Therefore, the current transmission speed may be improved, so that the power interface 100 has a fast charging function, which can improve the charging efficiency of the battery.

In one embodiment, as shown FIGS. 1-10, a mobile terminal may include a main body 110, a plurality of conductive data pins 120 spaced from each other, and a plurality of conductive power pins 130 spaced from each other. The main body 110 may be configured to be connected to a circuit board (not shown). The plurality of conductive data pins 120 are connected to the main body 110. The plurality of conductive power pins 130 are connected to the main body 110. The conductive data pins 120 and the conductive power pins 130 are spaced from each other and arranged along a length direction of the main body 110. Each of the conductive data pins 120 and conductive power pins 130 extends along a width direction of the main body 110. At least one of the conductive power pins 130 may have a first portion 130*c* having a width greater than that of any portion of each of the conductive data pins 120.

In one example, as shown in FIGS. 1 and 9, an insulating portion 130*b* may be arranged gaps 160 between the conductive data pins 120 and the conductive power pins 130.

In one example, as shown in FIG. 10, the first portion 130*c* defines a recess 133, the insulating portion is partly arranged in the recess 133.

In another example, as shown in FIGS. 6-9, the first portion 130*c* has a first surface 134 and a second surface 135 opposite to the first surface 134. The first portion 130*c* defines a first recess 133 at the first surface 134 and a second recess 133 at the second surface 135. A part of the insulating portion 130*b* is arranged in the first and second recesses 133.

In one example, as shown in FIG. 5, the first surface 134 is configured as a contact surface to be contacted with an electronic element (not shown).

In one example, as shown in FIGS. 2-3, each of the conductive data pins 120 and conductive power pins 130 may include a head end 131*a* and a connecting end 131*b* connected to the circuit board. The first portion 130*c* is located between the head end 131*a* and the connecting end 131*b*.

In one example, as shown in FIG. 2, connecting ends 131*b* of the conductive data pins 120 and conductive power pins 130 may be parallel to each other.

In one embodiment, a power adapter may include a circuit board (not shown) and a power interface 100. As shown in FIGS. 1-10, The power interface 100 may include a main body 110, a plurality of data pins 120, and a plurality of power pins 130. The main body 110 may be connected to the circuit board. The plurality of data pins 120 are spaced from each other and connected to the main body 110. The plurality of power pins 130 spaced from each other and connected to the main body 110. At least one of the power pins 130 have an expanded conductive portion 130*c*. A cross-sectional area of the expanded conductive portion 130*c* is greater than that of any portion of each of the data pins 120.

In one example, as shown in FIG. 9, an insulating portion 130*b* may be applied between gaps 160 between the power pins 130 and data pins 120.

In one example, as shown in FIG. 10, the expanded conductive portion 130*c* defines a recess 133, the insulating portion 130*b* is partly arranged in the recess 133.

In one example, as shown in FIGS. 6-9, the expanded conductive portion 130*c* has a first surface 134 and a second surface 135 opposite to the first surface 134. The expanded conductive portion 130*c* defines a first recess 133 at the first surface 134 and a second recess 133 at the second surface 135. A part of the insulating portion 130*b* is arranged in the first and second recesses 133.

In one example, as shown in FIGS. 2-3, each of the data pins 120 and power pins 130 may include a head end 131*a* and a connecting end 131*b* connected to the circuit board. The expanded conductive portion 130*c* is located between the head end 131*a* and the connecting end 131*c*.

In one example, as shown in FIG. 2, connecting ends 131*b* of the data pins 120 and power pins 130 are parallel to each other.

Reference throughout this specification, the reference terms "an embodiment", "some embodiments", "an example", "a specific example", or "some examples", and the like means that a specific feature, structure, material, or characteristic described in connection with the embodiment or example is included in at least one embodiment or example of the present disclosure. Thus, the illustrative descriptions of the terms throughout this specification are not necessarily referring to the same embodiment or example of the present disclosure. Furthermore, the specific features, structures, materials, or characteristics may be combined in any suitable manner in one or more embodiments or examples. In addition, one skilled in the art may combine the different embodiments or examples described in this specification and features of different embodiments or examples without conflicting with each other.

Although explanatory embodiments have been shown and described, it would be appreciated by one skilled in the art that the above embodiments previously described are illustrative, and cannot be construed to limit the present disclosure. Changes, alternatives, and modifications can be made in the embodiments without departing from scope of the present disclosure.

What is claimed is:

1. A mobile terminal, comprising:

a main body, configured to be connected to a circuit board;

a plurality of conductive data pins spaced from each other, connected to the main body; and a plurality of conductive power pins spaced from each other, connected to the main body, wherein the conductive data pins and the conductive power pins are spaced from each other and arranged along a length direction of the main body;

wherein each of the data pins and power pins extends along a width direction of the main body; at least one of the conductive power pins has a first portion having a width greater than that of any portion of each of the conductive data pins, and an insulating portion is arranged gaps between the conductive data pins and the conductive power pins;

wherein the first portion has a first surface and a second surface opposite to the first surface; the first portion defines a first recess at the first surface and a second recess at the second surface; a part of the insulating portion is arranged in the first and second recesses.

2. The mobile terminal of claim 1, wherein the first surface is configured as a contact surface to be contacted with an electronic element.

3. The mobile terminal of claim 1, wherein each of the conductive data and power pins comprises a head end and a connecting end connected to the circuit board; the first portion is located between the head end and the connecting end.

4. The mobile terminal of claim 3, wherein connecting ends of the conductive data and power pins are parallel to each other.

5. A power adapter, comprising a circuit board; and a power interface comprising:

a main body, connected to the circuit board;

a plurality of data pins spaced from each other and connected to the main body; and a plurality of power pins spaced from each other and connected to the main body, at least one of the power pins have an expanded conductive portion, wherein a cross-sectional area of the expanded conductive portion is greater than that of any portion of each of the data pins, and an insulating portion is applied between gaps between the power and data pins;

wherein the expanded conductive portion has a first surface and a second surface opposite to the first surface; the expanded conductive portion defines a first recess at the first surface and a second recess at the second surface; a part of the insulating portion is arranged in the first and second recesses.

6. The power adapter of claim 5, wherein each of the data and power pins comprises a head end and a connecting end connected to the circuit board; the expanded conductive portion is located between the head end and the connecting end.

7. The power adapter of claim 6, wherein connecting ends of the data and power pins are parallel to each other.

* * * * *